US006913810B2

(12) United States Patent
Wang et al.

(10) Patent No.: US 6,913,810 B2
(45) Date of Patent: Jul. 5, 2005

(54) INTERFACE TAPE

(75) Inventors: Dershi Wang, Bedford, NH (US); Howard A. Kingsford, Amherst, NH (US)

(73) Assignee: Velcro Industries B.V. (NL)

( * ) Notice: Subject to any disclaimer, the term of this patent is extended or adjusted under 35 U.S.C. 154(b) by 139 days.

(21) Appl. No.: 10/053,536

(22) Filed: Jan. 15, 2002

(65) Prior Publication Data

US 2003/0134083 A1 Jul. 17, 2003

(51) Int. Cl.[7] ..... B32B 3/06

(52) U.S. Cl. ..... 428/99; 428/100; 428/113; 24/445; 24/446; 24/448; 24/451; 442/183; 442/199; 442/209; 442/213; 442/214; 442/215; 442/216; 139/416; 139/418

(58) Field of Search ..... 428/100, 99, 113; 24/445, 446, 448, 451; 442/183, 199, 209, 213–216; 139/416, 418

(56) References Cited

U.S. PATENT DOCUMENTS

| | | | |
|---|---|---|---|
| 2,717,437 | A | 9/1955 | DeMestral |
| 3,261,069 | A | 7/1966 | Mathison |
| 3,319,307 | A | 5/1967 | Marforio |
| 3,387,345 | A | 6/1968 | Savoir |
| 3,469,289 | A | 9/1969 | Whitacre |
| 3,555,630 | A | 1/1971 | Wylde |
| 4,693,921 | A | 9/1987 | Billarant et al. |
| 4,710,414 | A | 12/1987 | Northrup et al. |
| 4,726,975 | A | 2/1988 | Hatch |
| 4,818,580 | A | 4/1989 | Bottger et al. |
| 4,842,916 | A | 6/1989 | Ogawa et al. |
| 4,931,344 | A | 6/1990 | Ogawa et al. |
| 4,933,224 | A | 6/1990 | Hatch |
| 5,169,709 | A | 12/1992 | Fleischer |
| 5,171,395 | A | 12/1992 | Gilcreast |
| 5,259,905 | A | 11/1993 | Gilcreast |
| 5,260,015 | A | 11/1993 | Kennedy et al. |
| 5,286,431 | A | 2/1994 | Banfield et al. |
| 5,399,418 | A | 3/1995 | Hartmanns et al. |
| 5,500,268 | A | 3/1996 | Billarant |
| 5,518,795 | A | 5/1996 | Kennedy et al. |
| 5,540,970 | A | 7/1996 | Banfield et al. |
| 5,606,781 | A | 3/1997 | Provost et al. |
| 5,659,930 | A | 8/1997 | Okawa |
| 5,736,217 | A | 4/1998 | Banfield et al. |
| 5,744,080 | A | 4/1998 | Kennedy et al. |
| 5,922,436 | A | 7/1999 | Banfield et al. |
| 5,945,193 | A | 8/1999 | Pollard et al. |
| 5,996,189 | A | 12/1999 | Wang |
| 6,129,970 | A | 10/2000 | Kenney et al. |
| 6,248,419 | B1 | 6/2001 | Kennedy et al. |
| 6,443,187 | B1 | 9/2002 | Wang et al. |

FOREIGN PATENT DOCUMENTS

| | | |
|---|---|---|
| CA | 977532 | 11/1975 |
| EP | 0246221 | 11/1987 |
| EP | 0439969 | 8/1991 |
| EP | 0 661 008 A | 7/1995 |
| FR | 2047243 | 3/1971 |
| FR | 2405123 | 5/1979 |
| FR | 2 761 863 A | 10/1998 |
| WO | WO92/19119 | 11/1992 |
| WO | WO96/25064 | 8/1996 |

*Primary Examiner*—Nasser Ahmad
*Assistant Examiner*—Jane Rhee
(74) *Attorney, Agent, or Firm*—Fish & Richardson, P.C.

(57) ABSTRACT

A faster tape is provided including (a) a molded resin base sheet with an array of integrally molded fastener elements extending from a first side of the base sheet; and (b) a substrate permanently secured to a second side of the base sheet, the substrate comprising first ad second yarns or fibers, the first yarn or fiber comprising a first polymeric material and the second yarn of fiber comprising a second, different polymeric materials, one of the polymeric materials being capable of adhesion to the resin of the base sheet.

29 Claims, 4 Drawing Sheets

INTERFACE TAPE

TECHNICAL FIELD

This invention relates to hook and loop fasteners, and more particularly to products and methods for bonding one of the components of a hook and loop fastener to a different material.

BACKGROUND

Due to the variety of polymers available today, products often include parts made of different polymers. These parts are often joined by welding, such as by heat, radio-frequency (RF) or ultrasonic welding. In some cases, different polymers are joined by insert molding a second polymer onto a part made of a first polymer.

For example, the hook component of a hook and loop fastener is often incorporated into a foam seat cushion, called a foam bun, by insert molding the hook component onto the foam bun with the hook elements exposed for engagement with a fabric seat covering. After insert molding, the hooks of the hook component are used to attach the seat covering to the foam bun.

In this example, it is important that there be satisfactory adhesion between the hook component and the foam bun. The hook component is generally made from nylon, and is bonded, e.g., by ultrasonic stitching, to a fabric backing of polyurethane-coated polyester to which the polyurethane foam generally adheres well during the insert molding process.

SUMMARY

In some cases, it is advantageous to bond together two polymers that do not bond well to each other. For example, in the above application, it may be advantageous to replace the nylon hook component with one made of polypropylene, because polypropylene remains dimensionally stable and is generally less expensive than nylon. However, polypropylene has a low surface energy and thus is difficult to bond to other polymers.

The inventor has found that two polymers that do not adhere well to each other may be joined by interposing between the two polymers an interface tape. The interface tape includes yarns or fibers of two different polymers, joined together to form a substrate. Generally, one of the polymers in the interface tape is capable of adhesion to one of the polymers to be bonded, and the other polymer in the tape is capable of adhesion to the other polymer to be bonded.

Thus, for example, in the application discussed in the Background, above, if the interface tape includes yarns of a polymer that adheres to polypropylene and yarns of a polymer that adheres to polyurethane, a strong chemical bond can be obtained between one face of the interface tape and a polypropylene hook component and between the other face of the interface tape and the polyurethane foam bun. As a result, the interface tape will securely bond the hook component to the foam bun despite the lack of adhesion between the polypropylene hook component and the polyurethane bun.

The fibers or yarns can be joined, for example, by weaving, knitting or nonwoven processes such as entangling. The phrase "joined together" as used herein, includes processes that do not mechanically join the fibers or yarns until a post-process step is performed, for example processes that involve laying down of layers of fibers that are later joined, e.g., by melting of a low-melting resin or incorporation of a binder, and also includes the formation of fiber batts. The different polymer yarns or fibers may be joined in a manner so that one polymer dominates a first face of the interface tape while a second polymer dominates a second face of the interface tape. Alternatively, the yarns or fibers may be joined in a manner so that both sides include an equal proportion of both polymers.

In one aspect, the invention features a fastener tape including (a) a molded resin base sheet with an array of integrally molded fastener elements extending from a first side of the base sheet; and (b) a substrate permanently secured to a second side of the base sheet, the substrate comprising first and second yarns or fibers, the first yarn or fiber comprising a first polymeric material and the second yarn or fiber comprising a second, different polymeric materials, one of the polymeric materials being capable of adhesion to the resin of the base sheet.

In another aspect, the invention features an interface tape including a substrate that includes first and second yarns or fibers, the first yarn or fiber comprising a first polymeric material and the second yarn or fiber comprising a second, different polymeric materials, the yarns or fibers being arranged so that the first yarn or fiber predominates on one side of the substrate and the second yarn or fiber predominates on the other side of the substrate.

Some implementations may include one or more of the following features. The polymeric materials of the first and second yarns are selected to be capable of adhesion to first and second polymers to be joined using the interface tape. Yarns or fibers of one polymer predominate on a first side of the substrate, and yarns or fibers of the other polymer predominate on a second, opposite side of the substrate. The substrate includes a woven, knitted or nonwoven material. The substrate includes a woven fabric. The yarns are woven in a plain, twill or satin weave, or a weave that is a combination or variation of any of these weaves. The molded resin base sheet includes polypropylene, and one of the polymeric materials is polypropylene. One of the polymeric materials is capable of adhesion to a polyurethane. Both yarns have a denier of from about 70 to 1000. The yarns may have the same or different deniers. The substrate includes a nonwoven material. The substrate further includes at least one magnetically attractable component, e.g., a magnetically attractable third yarn or fiber.

The invention also features a method of making a molded product including:

(a) inserting into a mold a fastener tape comprising:

(i) a molded resin base sheet with an array of integrally molded fastener elements extending from a first side of the base sheet, and (ii) a substrate permanently secured to a second side of the base sheet, the substrate comprising first and second yarns or fibers of two different polymeric materials, one of the polymeric materials being capable of adhering to the resin of the base sheet, with an exposed surface of the substrate facing a mold cavity defined by the mold; and (b) delivering a molding material to the mold cavity.

Some implementations include one or more of the following features. The molding material is a foam. The molded product is a seat cushion.

In a further aspect, the invention features a method of making a fastener tape, including (a) forming a strip-form base having a top surface, a bottom surface and fastener elements extending from the top surface; (b) forming a polymeric substrate comprising first and second yarns or fibers and having first and second surfaces; and (c) bonding the first surface of the polymeric substrate to the bottom surface of the strip-form base.

Some implementations include one or more of the following features. Yarns of a first polymeric material predominate on the first surface of the substrate, and yarns of a second polymeric material predominate on a second surface of the substrate. The step of bonding the substrate to the strip-form base includes: (a) continuously introducing molten resin to a gap defined adjacent a periphery of a rotating mold roll, such that the resin forms at least a part of the strip-form base of the fastener tape at the periphery of the mold roll and fills an array of fixed fastener element cavities defined in the rotating mold roll to form the fastener elements; while (b) continuously introducing the substrate to the resin forming the strip-form base, at a point at which the resin forming the strip-form base is disposed adjacent the periphery of the mold roll and under conditions selected to cause the first polymeric material to become permanently bonded to the resin of the strip-form base, while allowing at least a portion of the second polymeric material to be exposed; (c) solidifying the resin; and (d) stripping the fastener tape from the periphery of the mold roll by pulling the solidified fastener elements from their respective cavities. The step of bonding the substrate to the strip-form base occurs after the strip-form base is molded. The substrate and the strip-form base are thermally bonded. The substrate and the strip-form base are chemically or ultrasonically bonded. The fastener elements are integrally molded with the strip-form base. The fastener tape is lengthwise-continuous. The method further includes cutting the fastener tape into finite length pieces, e.g., using a hot knife or a shear.

The invention also features a fastener tape including (a) a molded resin base sheet with an array of integrally molded fastener elements extending from a first side of the base sheet; and (b) a substrate having a first surface that is permanently secured to a second side of the base sheet, the first surface comprising a first polymeric material that is capable of adhesion to the resin of the base sheet, and a second, exposed surface, the second surface comprising a second, different polymeric material that is capable of adhesion to a polymer other than the resin of the base sheet.

In another aspect, the invention features a method of bonding first and second parts that are formed of two different polymer that exhibit poor adhesion to each other, including (a) interposing between the two parts an interface tape comprising a first surface comprising a first polymeric material that is capable of adhesion to the polymer of the first part, and a second surface comprising a second, different polymeric material that is capable of adhesion to the polymer of the second part; and (b) bonding the first surface to the first part and the second surface to the second part.

Some implementations of this aspect of the invention include one or more of the following features. At least one of the parts includes a component of a hook and loop fastener. The bonding step includes insert molding. The two parts are bonded to the two surfaces during separate processing steps. The phrase "capable of adhesion," as used herein, means capable of forming a bond having sufficient strength for use in a particular application when subjected to appropriate processing conditions, for example heat, ultrasonic, chemical or radio-frequency welding, or insert molding. If desired, one or both surfaces of the interface tape may be coated to enhance adhesion. For instance, in the application discussed above, one surface of the interface tape may be coated with a polyurethane coating to enhance adhesion of the foam bun. One or both of the polymers in the interface tape may be capable of forming a bond of sufficient strength only when adhesion is enhanced by such a coating, and nonetheless be considered "capable of adhesion" as that phrase is used herein.

The details of one or more embodiments of the invention are set forth in the accompanying drawings and the description below. Other features and advantages of the invention will be apparent from the description and drawings, and from the claims.

DESCRIPTION OF DRAWINGS

Like reference symbols in the various drawings indicate like elements.

DETAILED DESCRIPTION

Figure 1:
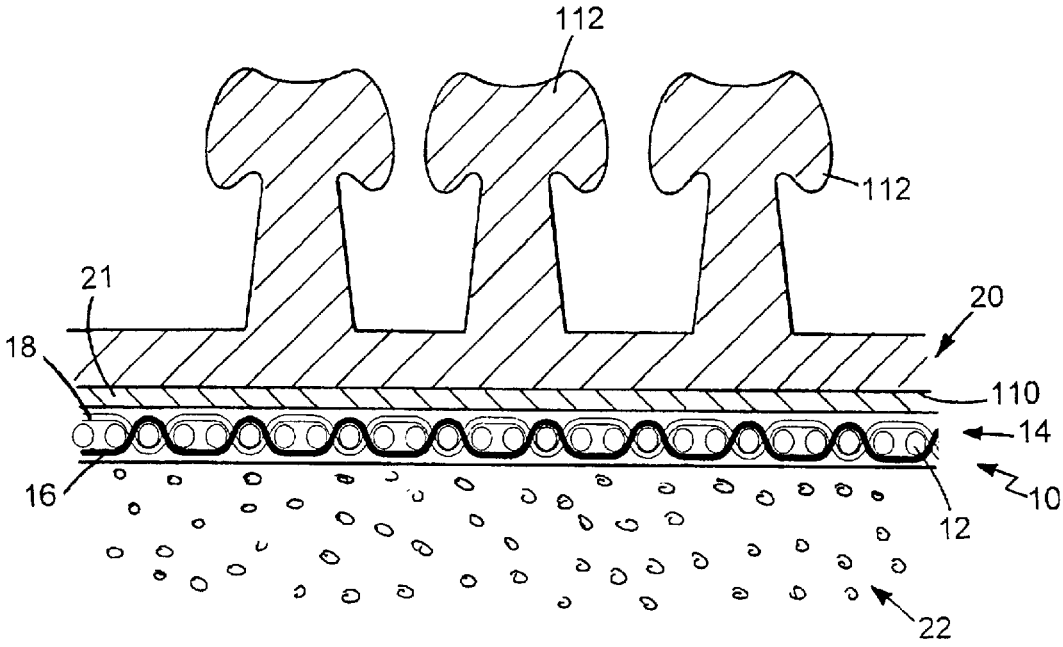
FIG. 1 is a cross-sectional view of an interface tape bonding a hook component of a hook and loop fastener to a foam bun according to one embodiment of the invention.

Referring to FIG. 1, an interface tape 10 includes weft yarns 12 and warp yarns 16 and 18. In this and in each of the following examples, the warp yarns are made of two different polymers. In the embodiment shown in FIG. 1, the interface tape 10 is woven or knitted so that one warp yarn 16 dominates a first surface of the interface tape, while the second warp yarn 18 dominates a second surface of the interface tape, parallel to the first surface. As a result, the interface tape 10 can be used to bond, for example, a hook component 20 of a hook and loop fastener, to which the polymer of warp yarn 16 can be bonded, to a foam seat cushion 22, also called a foam bun, to which the polymer of warp yarn 18 can be bonded (e.g., by insert molding the foam to the second surface of the interface tape), as shown in FIG. 1.

Figure 2:
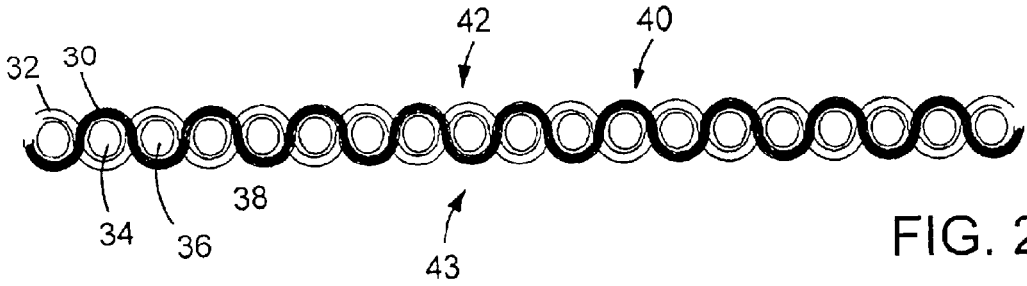
FIG. 2 is a cross-sectional view of a woven interface tape according to one embodiment of the invention.

Referring to FIG. 2, in one embodiment the interface tape may be woven in a plain (1/1) weave. A plain weave includes one warp yarn 30 fed over a first weft yarn 34, under an adjacent weft yarn 36, and then over a next adjacent weft yarn 38, while an adjacent warp yarn 32 is fed under the first weft yarn 34, over the adjacent weft yarn 36 and then under the next adjacent weft yarn 38. This pattern will continue alternating warp yarns to form a fabric sheet 40 in which there is an equal amount of each warp yarn on both surfaces 42, 43 of the fabric sheet 40. Thus, neither surface is dominated by one of the warp yarns, assuming that the size and number of the two warp yarns is identical.

Figure 3:
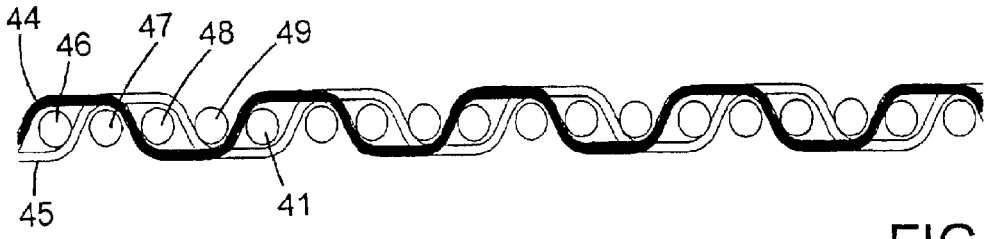
FIG. 3 is a cross-sectional view of an interface tape according to another embodiment of the invention.

FIG. 3 shows an alternate embodiment, in which the weave is a 2/2 twill. In this case, one warp yarn 44 is fed over two adjacent weft yarns 46, 47, and then under two adjacent weft yarns 48, 49, while a second warp yarn 45 is fed under the first weft yarn 46, then over the next two adjacent weft yarns 47, 48, and under the next two adjacent weft yarns 49, 41. This pattern continues, alternating warp yarns to form a fabric sheet that will have an equal amount of each warp yarn on both surfaces of the fabric sheet, again assuming that the size and number of the two warp yarns is identical.

Figure 4:
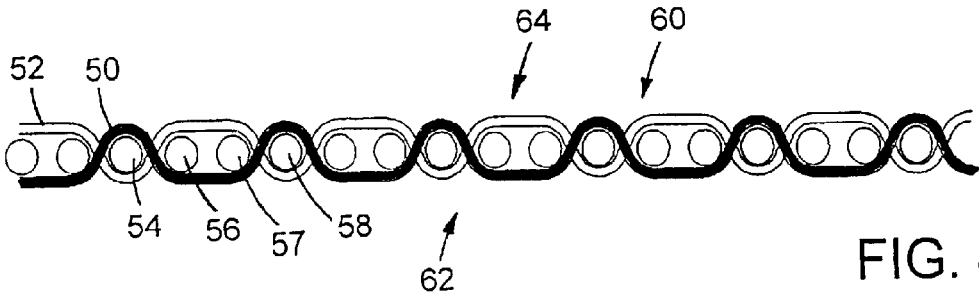
FIG. 4 is a cross-sectional view of an interface tape according to another embodiment of the invention.

FIG. 4 shows a 1/2, 2/1 twill, a weave in which one polymer dominates one surface and the other polymer dominates the other surface. In this case, one warp yarn 50 is fed over a first weft yarn 54, under two adjacent weft yarns 56, 57, and over the next adjacent weft yarn 58, while an adjacent warp yarn 52 is fed under the first weft yarn 54, over the two adjacent weft yarns 56, 57, and under the next adjacent weft yarn 58. This pattern continues, alternating warp yarns to form a fabric sheet 60 in which one warp yarn 50 comprises 66.6% of one surface 62 of the fabric sheet 60 and the other warp yarn 52 comprises 66.6% of the other parallel surface 64 of the fabric sheet 60, again assuming that the two warp yarns have the same size and number.

Figure 5:
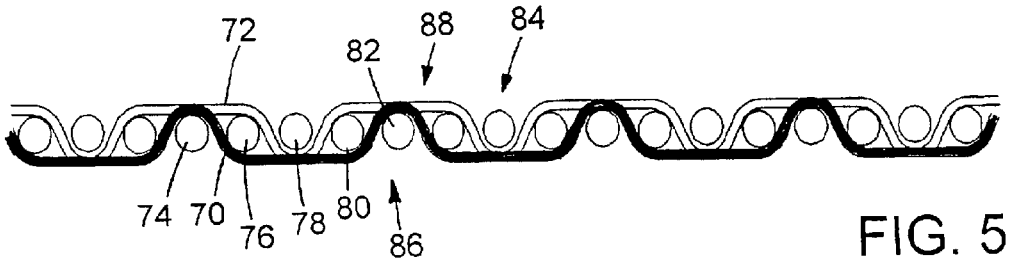
FIG. 5 is a cross-sectional view of an interface tape according to an alternate embodiment of the invention.

Referring to FIG. 5, in another embodiment the interface tape is woven in a 1/3, 3/1 twill. In this weave a first warp yarn 70 is fed over a first weft yarn 74, then under three adjacent weft yarns 76, 78, 80, and over the next adjacent weft yarn 82, while a second warp yarn 72 is fed under a first weft yarn 74, then over three adjacent weft yarns 76, 78, 80, and then under the next adjacent weft yarn 82. This pattern continues, alternating warp yarns to form a fabric sheet 84 in which the first warp yarn 70 comprises 75% of one surface 86 of the fabric sheet 84 and the other warp yarn 72 comprises 75% of the other parallel surface 88 of the fabric sheet, assuming that the warp yarns are of the same size and number.

Figure 6:
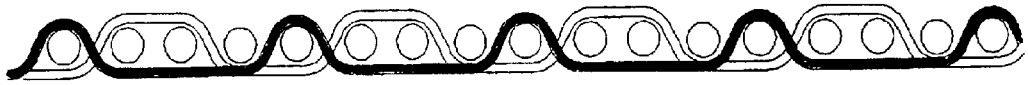
FIG. 6 is a cross-sectional view of an interface tape according to another alternate embodiment of the invention.

Referring to FIG. 6, in another alternate embodiment the interface tape is woven in a 2/2, 1/3 twill. In this case, a first warp yarn 90 is fed over a first weft yarn 93, then under three adjacent weft yarns 94, 95, 96, over the next adjacent weft yarn 97, and under the next three adjacent weft yarns 98, 99, 100, while a second warp yarn 92 is fed under the first weft yarn 93, over the next two adjacent weft yarns 94, 95, under the next two adjacent weft yarns 96, 97, over the next two adjacent weft yarns 98, 99 and under the next two adjacent weft yarns 100, 101. This pattern continues, alternating warp yarns to form a fabric sheet 102 in which the first warp yarn 90 comprises 60% of one surface 104 of the fabric sheet 102 and the other warp yarn 92 comprises 66% of the other parallel surface 106 of the fabric sheet, again assuming that the warp yarns are of the same size and number.

Referring again to FIGS. 3–6, it should be understood that the next adjacent warp yarns may start their patterns over or under different weft yarns than described. For example, in FIG. 3, the next adjacent warp yarn (not shown) below warp yarn 45 may start by going over weft yarn 46, then under the next two adjacent weft yarns 47, 48, and over the next two adjacent weft yarns 49, 41, continuing the pattern as described above.

Referring again to FIG. 1, the interface tape 10 is used to bond a hook component 20 of a hook and loop tape to a foam bun 22. As discussed above, the hook component 20 may be made of polypropylene and the foam bun 22 may be made of a polyurethane foam. To provide bonding between these two parts, yarns 16 would be of a material that is capable of adhesion to the polypropylene of hook component 20, and yarns 18 would be of a material that is capable of adhesion to the polyurethane foam bun 22. Thus, yarns 16 would generally be formed of or have a sheath or coating of polypropylene or a polymer that is capable of adhesion to polypropylene, and yarns 18 would be is formed of or have a sheath or coating of polyurethane or a polymer that is capable of adhesion to polyurethane. These yarns may be woven in any of the manners described above. Yarns 16 will bond to the polypropylene hook component and yarns 18 will bond to the foam bun, bonding the hook component firmly to the foam bun.

Generally, in the example described above, the interface tape 10 is bonded to the hook component 20 prior to placement of the hook component in the mold. This may be accomplished by welding, e.g., heat, ultrasonic, chemical, or radio-frequency welding, after the hook tape has been formed.

Alternatively, the interface tape 10 may be bonded to the hook component 20 while the hook component is being formed. The hook component may be formed, for example, by the Kennedy one-wrap process, described in U.S. Pat. No. 6,248,419, entitled LAMINATED HOOK FASTENER, the disclosure of which is incorporated herein by reference.

Figure 7:
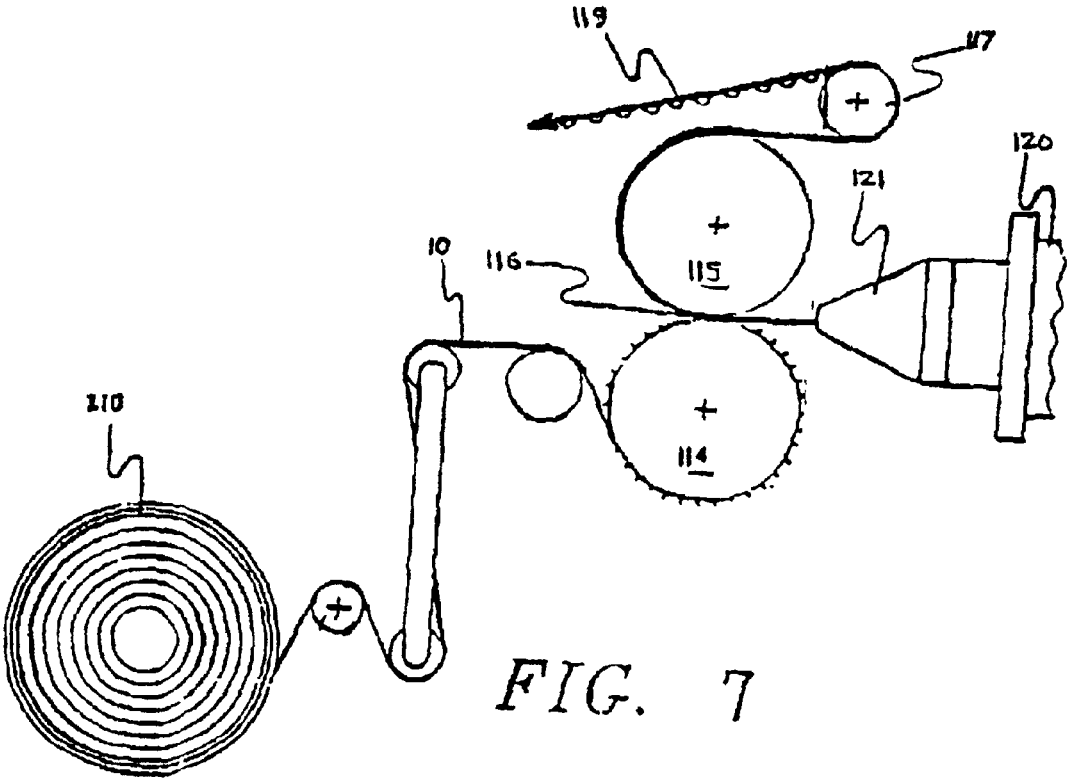
FIG. 7 is a side view of an apparatus used to bond the interface tape to a hook component.

An example of such a process is shown in FIG. 7. In this process, the interface tape 10 is provided on a roll 110. The interface tape 10 is fed into the nip 116 between a base roller 114 and a cavity roller 115. The cavity roller 115 contains cavities to form the hooks 112 of the hook component. The extruder barrel 120 melts and forces a molten polymer, e.g., polypropylene, through a die 121 and into the nip 116. The interface tape is fed into the nip with a first surface of the tape in contact with the molten polymer, i.e. facing the cavity roller 115. The heat of the molten polymer in the hook component will thermally weld the extruded polymer to the first surface of the interface tape. A second, opposite surface of the interface tape is in contact with the base roller 114. The resulting hook component 20, with the interface tape welded to its lower surface 108 (the surface that is opposite the side that includes hooks 112), travels around the periphery of the cavity roller 115 and around strip roller 117. The strip roller 117 assists in pulling the formed hooks 112 from the cavity roller 115. The finished product 119 can then be wound into roll form on a windup device (not shown).

During this process, a steel shim 21 can also be laminated between the interface tape and the hook component (FIG. 1). The steel shim 21 can be introduced into the nip 116 between the interface tape 10 and the molten polypropylene. The steel shim 21 generally should be narrower than the hook component 20 and the interface tape 10 to allow at least a portion of the interface tape to directly contact the lower surface 108 of the hook component. However, the steel shim may be the same width as the hook component and interface tape, in which case it would generally include holes (not shown) through which the molten polymer could flow and contact the interface tape, or any other configuration that will allow the molten polymer to contact the interface tape. The steel shim 21 can be used to hold the hook component 20 in a mold, as described below.

Other methods can also be used to attach the interface tape to the hook component.

To form a molded product, the hook component 20 with the integrated interface tape 10 is placed in a mold. The mold is used, for example, to form a foam bun, e.g., as described in U.S. Pat. No. 5,945,193 to Pollard, entitled TOUCH FASTENER WITH POROUS METAL CONTAINING LAYER, incorporated herein by reference.

Figure 8:
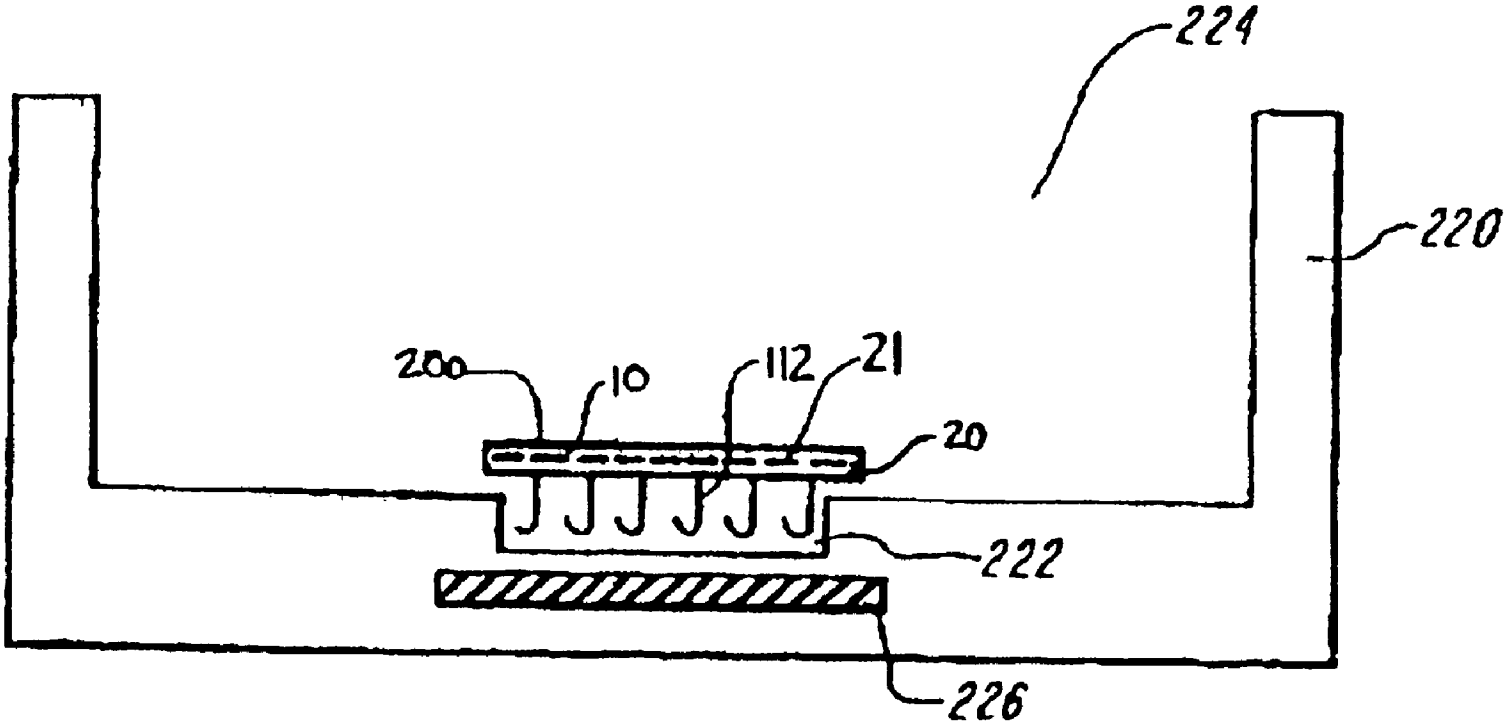
FIG. 8 is a cross-sectional view of an interface tape and hook component in a foam bun mold.

As shown in FIG. 8, the hook component is placed in a fastening element-receiving mold valley 222 of a mold 220, with the non-hook-carrying side 200 of interface tape 10 facing into the mold cavity 224. The steel shim 21 will hold the hook component 20 in place due to the magnetic attraction to magnet 226. Hot, molten polyurethane foam is poured into the mold cavity 224, where it comes into contact with the interface tape. The hot foam thermally welds to the polyester yarns of the interface tape, thereby bonding the interface tape 10, and the attached hook component 20, to the foam bun.

A number of embodiments of the invention have been described. Nevertheless, it will be understood that various modifications may be made without departing from the spirit and scope of the invention.

For example, instead of laminating a steel shim between the interface tape and hook component, magnetically attractive yarns may be woven into the interface tape. The magnetically attractive yarns can be the weft yarns with polymeric warp yarns. Alternately, a few magnetically attractive yarns can be incorporated as warp yarns in place of several polymeric warp yarns. The magnetic yarns will allow the hook component to be held in the mold described above while the foam bun is formed.

Also, while thermal welding has been described as a suitable technique for bonding the hook component to the interface tape, chemical (e.g., adhesive), radio-frequency or ultrasonic welding are also suitable techniques to weld the interface tape to either or both components.

Further, while weaving has been described above, the yarns may be knitted to form the interface tape. Both warp and weft knitting may be used. Moreover, the interface tape may be a nonwoven material. In the case of a nonwoven, the interface tape may be formed by entangling fibers of two different polymers.

Other weaves may be used. For example, it is not necessary that one polymer dominate one face and the other dominate the other face. If desired, both faces may include equal amounts of each polymer yarn, so long as the desired degree of bonding is provided in the particular application in which the interface tape is used.

Also, yarns of different deniers and different numbers may be used to vary the proportions of the two polymers on the two sides of the tape.

While a foam bun and a hook component have been described above by way of example, the interface tape may be used to bond any desired polymeric components together.

Moreover, any desired polymers may be used as the yarns or fibers, to be selected based on compatibility with and adhesion to the polymers that are to be joined. The yarns or fibers may be formed of a single polymer or a blend of polymers, or may be bicomponent yarns or fibers, formed of two or more coextruded polymers. The coextruded polymers may be provided in a sheath/core or side-by-side arrangement, or any other desired arrangement. In a sheath/core arrangement, the sheath material may be selected to provide adhesion, while the core may be selected to provide other desired properties, e.g., strength or flexibility.

While yarns have been referred to in the woven examples above, staple or filament fibers or combinations of such fibers with each other and/or with yarns may also be used.

Accordingly, other embodiments are within the scope of the following claims.

What is claimed is:

1. A fastener tape comprising (a) a molded resin base sheet with an array of integrally molded fastener elements extending from a first side of the base sheet; and (b) a substrate permanently secured to a second side of the base sheet, the substrate comprising first and second yarns or fibers, the first yarn or fiber comprising a first polymeric material and the second yarn or fiber comprising a second, different polymeric material, wherein one of the polymeric materials is capable of adhesion to the resin of the base sheet, wherein the first yarn or fiber predominates on a first surface of the substrate, and the second yarn or fiber predominates on a second, opposite surface of the substrate, and wherein both the first and second yarns or fiber are present on both the first and second surfaces of the substrate.

2. The fastener tape of claim 1 wherein the substrate comprises a woven, knitted or nonwoven material.

3. The fastener tape of claim 2 where the substrate comprises a woven fabric.

4. The fastener tape of claim 3 wherein the fabric is woven in a plain, twill, or satin weave, or a combination or variation of such weaves.

5. The fastener tape of claim 1 wherein the molded resin base sheet comprises polypropylene, and one of the polymeric materials comprises polypropylene.

6. The fastener tape of claim 1 or 5 wherein one of the polymeric materials is capable of adhesion to a polyurethane.

7. The fastener tape of claim 1 wherein both the first and second yarns or fibers have a denier of from about 70 to 1000.

8. The fastener tape of claim 1 or 7 wherein the first and second yarns or fibers have different deniers.

9. The fastener tape of claim 1 wherein said substrate is a nonwoven material.

10. The fastener tape of claim 1 wherein the fabric further comprises at least one magnetically attractable third yarn or fiber.

11. The fastener tape of claim 1 wherein one of the yarns or fibers is coated with polyurethane.

12. The fastener tape of claim 1 wherein one of the yarns or fibers includes an outer surface that comprises polyurethane.

13. The fastener tape of claim 1 wherein at least one surface of the substrate is coated with a coating selected to enhance adhesion.

14. The fastener tape of claim 1 wherein a surface of the substrate opposite to the surface to which the base sheet is secured is coated with a polyurethane coating.

15. An interface tape comprising:

a substrate comprising first and second yarns or fibers, the first yarn or fiber comprising a first polymeric material and the second yarn or fiber comprising a second, different polymeric material, the yarns or fibers being arranged so that the first yarn or fiber predominates on a first surface of the substrate and the second yarn or fiber predominates on a second surface of the substrate, and wherein both the first and second yarns or fibers are present on both the first and second surfaces of the substrate.

16. The interface tape of claim 15 wherein the polymeric materials of the first and second yarns are selected to be capable of adhesion to, respectively, first and second polymers to be joined using the interface tape.

17. The interface tape of claim 15 wherein the substrate comprises a woven, knitted or nonwoven material.

18. The interface tape of claim 17 where the substrate comprises a woven fabric.

19. The interface tape of claim 18 wherein the fabric is woven in a plain, twill, or satin weave, or a combination or variation of such weaves.

20. The interface tape of claim 15 wherein one of the polymeric materials comprises polypropylene.

21. The interface tape of claim 15 or 20 wherein one of the polymeric materials is capable of adhesion to a polyurethane.

22. The interface tape of claim 15 wherein both the first and second yarns or fibers have a denier of from about 70 to 1000.

23. The interface tape of claim 15 or 22 wherein the first and second yarns or fibers have different deniers.

24. The interface tape of claim 15 wherein said substrate comprises a nonwoven material.

25. The interface tape of claim 15 wherein the substrate further comprises at least one magnetically attractable third yarn or fiber.

26. The interface tape of claim 15 wherein one of the yarns or fibers is coated with polyurethane.

27. The interface tape of claim 15 wherein one of the yarns or fibers includes an outer surface that comprises polyurethane.

28. The interface tape of claim 15 wherein at least one surface of the substrate is coated with a coating selected to enhance adhesion.

29. The interface tape of claim 15 wherein a surface of the substrate is coated with a polyurethane coating.

* * * * *